United States Patent [19]

Siwiak

[11] Patent Number: 4,574,290

[45] Date of Patent: Mar. 4, 1986

[54] HIGH GAIN VERTICALLY POLARIZED ANTENNA STRUCTURE

[75] Inventor: Kazimierz Siwiak, Sunrise, Fla.

[73] Assignee: Motorola, Inc., Schaumburg, Ill.

[21] Appl. No.: 570,574

[22] Filed: Jan. 13, 1984

[51] Int. Cl.[4] ..... H01Q 9/32

[52] U.S. Cl. ..... 343/827; 343/891

[58] Field of Search ..... 343/826, 827, 891, 896, 343/796–800

[56] References Cited

U.S. PATENT DOCUMENTS

| | | | |
|---|---|---|---|
| 2,213,692 | 9/1940 | Cork et al. | 343/800 |
| 2,267,613 | 12/1941 | Lindenblad | 343/799 |
| 2,533,900 | 12/1950 | Shanklin | 343/800 |
| 2,539,433 | 1/1951 | Kandoian | 343/800 |
| 2,781,513 | 2/1957 | Peterson | 343/798 |
| 3,000,008 | 9/1961 | Pickles | 343/898 |
| 4,180,820 | 12/1979 | Johns | 343/798 |
| 4,203,118 | 5/1980 | Alford | 343/890 |

FOREIGN PATENT DOCUMENTS

| | | | |
|---|---|---|---|
| 2910813 | 9/1979 | Fed. Rep. of Germany | 343/891 |

OTHER PUBLICATIONS

IEEE Transactions on Vehicular Communications "A New Series of Commercial Base Station Antennas", G. J. Bischak, pp. 24–27, Sep. 1964.

"High Gain Side Firing Hellical Antennas for Ultrahigh Frequency Television Broadcasting", American Institute of Electrical Eng., vol. 73, 1954, pp. 135–138.

*Primary Examiner*—Eli Lieberman

*Attorney, Agent, or Firm*—Daniel K. Nichols; Joseph T. Downey; Edward M. Roney

[57] ABSTRACT

A high gain vertically polarized antenna section includes a hollow conductive central cylinder which is used to encase feed lines and power dividers used for feeding the antenna section. The cylinder is surrounded by an array of symmetrically disposed vertical radiating elements arranged in a plurality of symmetrical columns. A plurality of ring transmission lines or shorted quarter-wave stubs are utilized to distribute electrical energy to each of the vertical radiators in a manner such that the instantenous current flow is in the same direction in all of the vertical radiating elements. Any horizontal currents in the ring transmission lines or shorted quarter-wave is substantially cancelled by out-of-phase horizontal currents.

8 Claims, 10 Drawing Figures

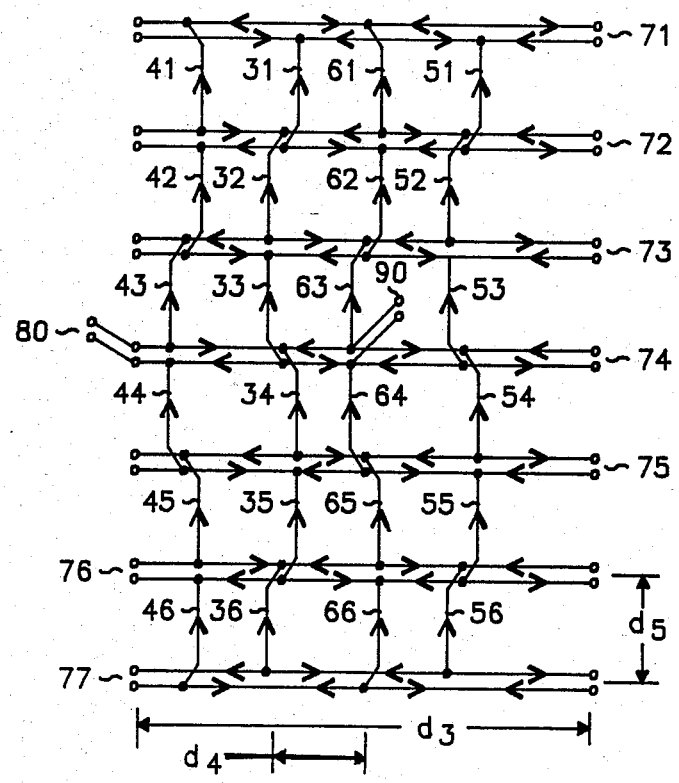
Fig. 2
Fig. 3
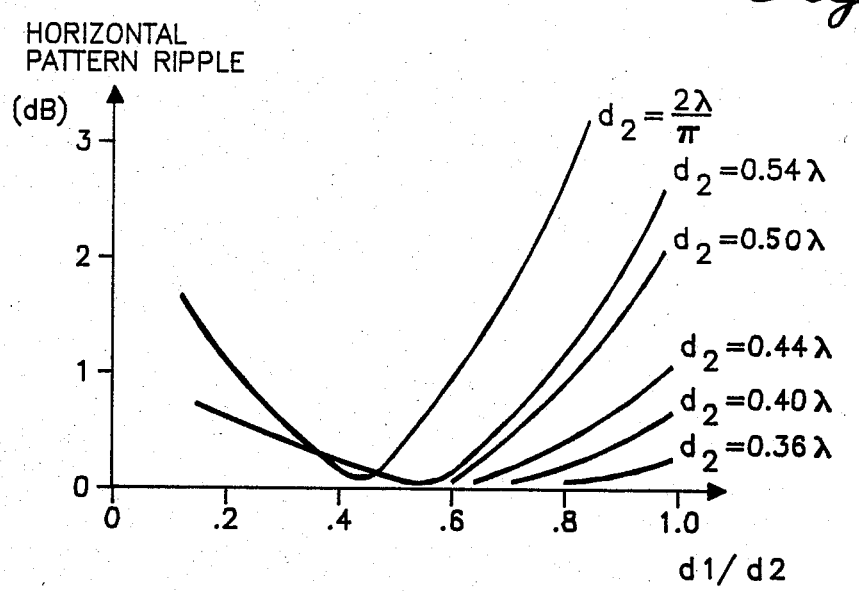

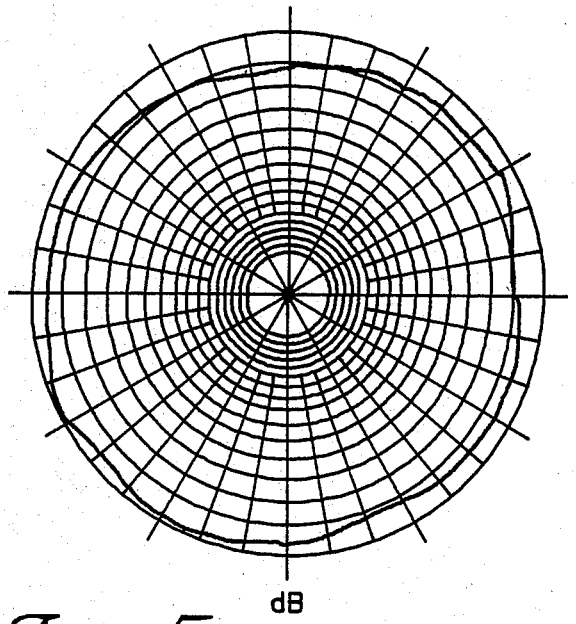
Fig. 5
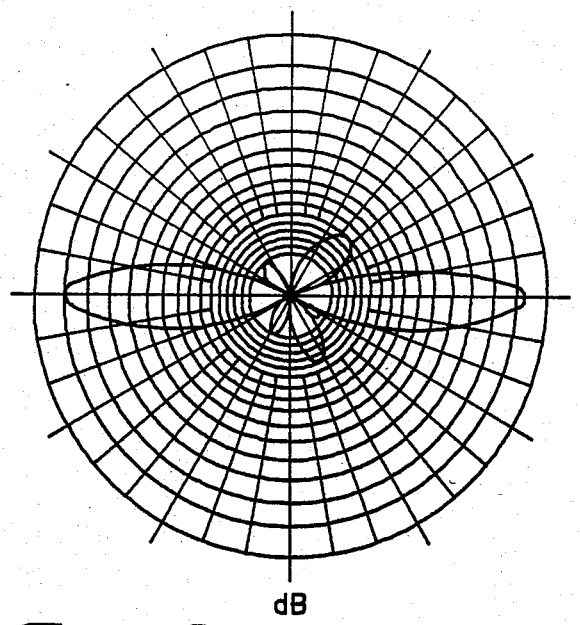
Fig. 6
Fig. 7
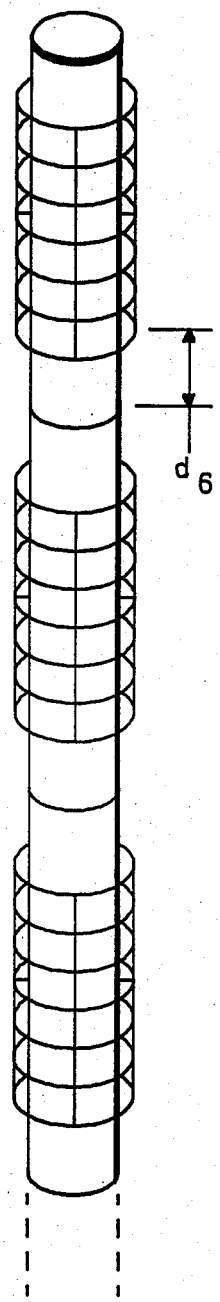

HIGH GAIN VERTICALLY POLARIZED ANTENNA STRUCTURE

BACKGROUND OF THE INVENTION

1. Field of the Invention

This invention relates generally to the field of high gain antenna structures suitable for vertical stacking. More particularly, this invention relates to a vertically polarized antenna structure exhibiting omni-directional coverage in the horizontal plane and high gain at the horizon. In ground based communication systems, such as paging systems, it is desirable for the paging transmitter antenna to exhibit vertical polarization with omni-directional coverage in the horizontal plane and high gain at the horizon in order to achieve maximum enhancement of range in the communication systems.

2. Background of the Invention

In the prior art, various colinear series fed arrays have been utilized in such ground based communication systems. Unfortunately, such antenna configurations must be series fed and when many sections are stacked to obtain high gain, a notable loss in bandwidth is experienced.

The present invention is directed towards an antenna section which may be readily stacked to obtain high gain without sacrifice of bandwidth. In this antenna structure, the bandwidth is determined by each individual antenna section. Each section is parallel fed and all interconnecting cables between sections may be hidden within a central conductive cylinder thereby eliminating the problem of antenna pattern disruption by interference and scattering from the transmission lines that feed the individual antenna sections.

SUMMARY OF THE INVENTION

It is an object of the present invention to provide a high gain omni-directional antenna.

It is another object of the present invention to provide high gain vertically polarized antenna section which may be stacked for increased gain without severe degradation of bandwidth.

It is another object of the present invention to provide a vertically polarized antenna exhibiting high gain at the horizon.

It is a further object of the present invention to provide a vertically polarized wide bandwidth antenna which may be stacked for greater gain and parallel fed to preserve bandwidth.

These and other objects of the invention will become apparent to those skilled in the art upon consideration of the following description of the invention.

In one embodiment of the present invention, a high gain vertically polarized antenna structure for operation over a predetermined range of frequencies about a center frequency includes a hollow vertical conductive cylinder having a first radius about a central vertical axis. The conductive cylinder is surrounded by an array of vertical radiating elements arranged so that each of the vertical radiating elements is positioned about a second radius larger in magnitude than the first radius. The array of vertical elements is preferrably arranged in vertical columns in parallel with the central vertical axis of the hollow vertical conductive cylinder. A distribution network supplies electrical energy to each of the vertical radiating elements so that the instantenous current flows in the same direction in all of the vertical radiating elements and any horizontal currents in the distribution network are substantially cancelled by other out-of-phase horizontal currents. An input network is coupled to the distribution network and positioned within the hollow vertical conductive cylinder for receiving an electrical signal and supplying that electrical signal to the distribution network.

The features of the invention believed to be novel are set forth with particularity in the appended claims. The invention itself however, both as to organization and method of operation, together with further objects and advantages thereof, may be best understood by reference to the following description taken in conjunction with the accompanying drawings.

BRIEF DESCRIPTION OF THE DRAWINGS

FIG. 2 is an unwrapped view of the vertical radiating elements and their interconnection to the ring transmission lines when the structure of FIG. 1 is sectioned along lines 2—2 and flattened.

FIG. 3 is a graph of ripple in the horizontal antenna pattern as a function of the ratio of dimensions $d_1$ and $d_2$.

FIG. 5 shows a horizontal radiation pattern for one embodiment of an antenna section of the present invention.

FIG. 6 shows a vertical radiation pattern for one embodiment of an antenna of the present invention.

FIG. 7 shows a stacking arrangement utilizing three of the antenna sections of the present invention.

Figure 1:
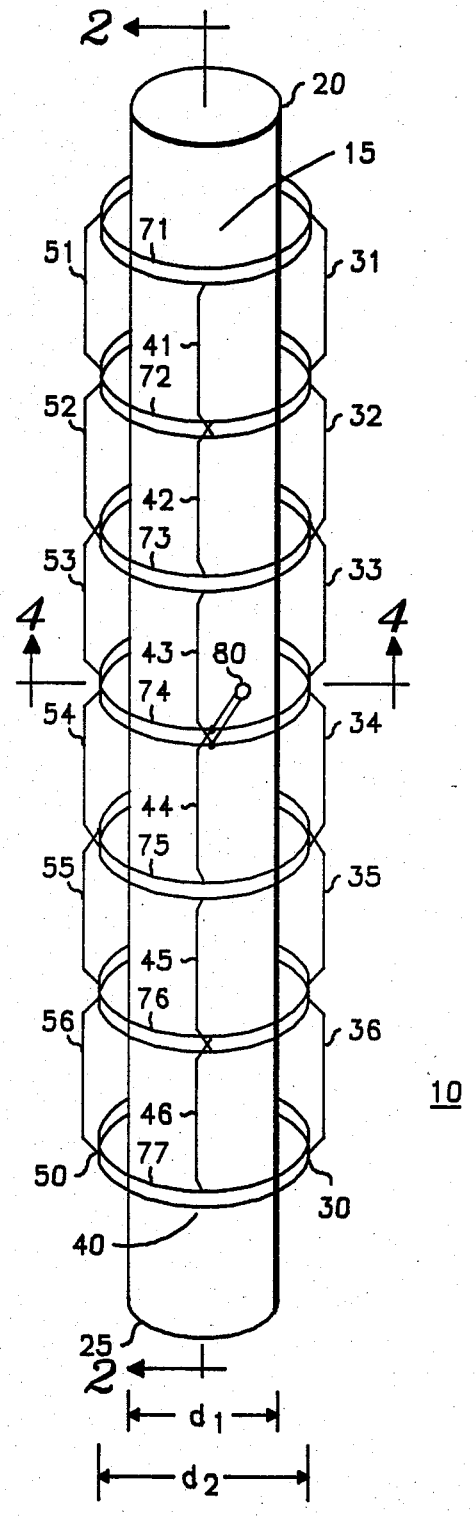
FIG. 1 is a view of an embodiment of the antenna section of the present invention.

DETAILED DESCRIPTION OF THE PREFERRED EMBODIMENT:

Turning now to FIG. 1 an antenna section in accordance with the present invention is shown generally as 10. Antenna section 10 includes a hollow conductive cylinder 15 having an upper end 20 and a lower end 25. Cylinder 15 is centrally located in the antenna structure and has an outer diameter $d_1$. Upper end 20 and lower end 25 may also include a coupling mechanism to be used in coupling a number of sections such as antenna section 10 together to form a vertical array. Any number of such coupling mechanisms will occur to those skilled in the art.

Four columns of vertical radiating elements 30, 40, 50 and 60 (60 not shown in this view) are disposed symmetrically about the cylinder 15. Preferrably, columns 30, 40, 50 and 60 are located at 90° angles about a central axis running vertically through the center of cylinder 15. The columns of vertical radiators are located an equal radial distance from this imaginary central vertical axis on a circle having diameter designated $d_2$. Each of the columns of vertical radiators includes a plurality of vertical radiating elements. In the embodiment shown six 6 elements per column is utilized but other numbers of radiating elements may be preferred depending upon the antenna parameters desired. More radiators will result in increased gain at the expense of bandwidth.

In this embodiment, column 30 includes radiating elements 31, 32, 33, 34, 35 and 36. Column 40 includes radiating elements 41, 42, 43, 44, 45, and 46. Column 50 includes radiating elements 51, 52, 53, 54, 55 and 56. Column 60 is preferrably situated diametrically opposite column 40 and is therefore not visible in the view of FIG. 1. Column 60 includes radiating elements 61, 62, 63, 64, 65 and 66. Each of the vertical radiating elements include an upper end and a lower end.

In the preferred embodiment the four columns of radiating elements are coupled to a distribution network made up of ring parallel transmission lines 71, 72, 73, 74, 75, 76 and 77. Ring parallel transmission lines 71 through 77 are simply parallel transmission lines such as 300 ohm twin-lead configured in a continuous loop with each of the transmission lines having an upper and a lower conductor.

The upper conductor of ring transmission line 71 is connected to the top of elements 31 and 51. The lower conductor of ring transmissions line 71 is connected to the top of elements 41 and 61. The upper conductor of ring transmission line 72 is connected to the bottom of elements 31 and 51 and the tops of elements 42 and 62. The lower conductor of ring transmission line 72 is connected to the bottom of elements 41 and 61 and the top of elements 32 and 52. The upper conductor of ring transmission line 73 is connected to the bottom of elements 42 and 62 and the top of elements 33 and 53.

Ring transmission line 74 is centrally located about cylinder 15 and its upper conductor is connected to the bottom of elements 33 and 53 and the tops of elements 44 and 64. The lower conductor of ring transmission line 74 is connected to the bottom of elements 43 and 63 and the tops of elements 34 and 54. The elements situated below ring transmission line 74 are symmetrical in location and connection with those above ring transmission line 74.

The upper conductor of ring transmission line 75 is connected to the bottom of elements 44 and 64 and the top of elements 35 and 55. The lower conductor of ring transmission line 75 is connected to the bottom of elements 34 and 64 and the top of elements 45 and 65. The upper conductor of ring transmission 76 is connected to the bottom of elements 35 and 55 and the top of elements 46 and 66. The lower conductor of ring transmission line 76 is connected to the bottom of elements 45 and 65 and the top of elements 56 and 36. The upper conductor of ring transmission line 77 is connected to the bottom of elements 46 and 66 and the upper conductor of ring transmission line 76 is connected to the bottom of elements 36 and 56. Although N+1 ring transmission lines are shown in FIG. 1, it will be clear that ring transmission lines 71 and 77 may be viewed as optional so that if there are N vertical radiating elements per column, N−1 ring transmission lines may be used.

The symmetry displayed in the above configuration may of course be utilized by one skilled in the art for interconnecting arrays having a different number of columns and/or a different number of vertical radiating elements in each column without departing from the spirit of the present invention.

In one embodiment of the present invention, electrical energy is provided to the ring transmission lines 71–77 and columns 30, 40, 50 and 60 symmetrically at drive points 80 and 90. Drive point 90 is not visible in FIG. 1 but it is diametrically opposed to drive point 80. Various arrangements for driving the present antenna structure will occur to those skilled in the art and several examples will be discussed in more detail later.

Turning now to FIG. 2, a view of the ring transmission line structure along with the vertical radiating elements is shown when the antenna section structure is cut along line 2—2 and unrolled into a planar configuration. While the drawing appears to show that there are varying distances between one junction of radiating elements and ring transmission lines to the next, it should be understood that these distances are approximately uniform and the discrepancies in length are merely a function of the drawing.

Length $d_3$ is the circumference of the ring transmission lines and in the preferred embodiment this length is approximately two wavelengths in the transmission line medium at the center frequency of the antenna's operation. Length $d_4$ is $\frac{1}{4}$ of the circumference and is therefore approximately equal to one half wavelength. Distance $d_4$ is the distance between any two adjacent vertical radiating elements coupled to any given ring transmission line. Length $d_5$ is the length of the vertical radiating elements and in the present embodiment length $d_5$ is approximately equal to one half wavelength in the medium of the radiating elements which is preferably air or free space. One skilled in the art however, will recognize that any length slightly more than one-half wavelength to less than one-half wavelength could be utilized for length $d_5$ if appropriately compensated by the configuration of the distribution network or by dielectric loading of the vertical radiating elements.

In order to more fully understand the operation of the present invention arrow heads have been placed on each of the vertical radiating elements and on each of the ring transmission line conductors between each of the vertical radiating elements in FIG. 2. These arrowheads represent the direction of instantaneous current flow and it will be clear to those skilled in the art that this direction is only valid for one-half cycle of a sinusoidal excitation after which, the directions of each arrowhead will change.

When in-phase energy is applied to drive points 80 and 90, the phase directions shown or their compliment will result. It should be noted that the instantaneous direction of current flow in each of the vertical radiating elements 41 through 46, 31–36, 61–66, and 51–56 are all in the same direction. On the other hand, the direction of current flow in each segment of each ring transmission line exhibits a current flowing in opposite direction in each conductor of each transmission line. As a result, the present configuration results in a high degree of vertical polarization while any currents which will result in horizontal radiation are cancelled by out-of-phase currents having approximately equal amplitude. As a result, a high degree of vertical polarization is obtainable without sacrifice of bandwidth.

Computer simulations have shown that in order to approximate zero decibels ripple in the horizontal radiation pattern, at least four columns of vertical radiating elements are needed. In the preferred embodiment four columns are utilized because this is the minimum number to obtain near zero decibels ripple and is therefore the simplest configuration. For a four column structure, horizontal ripple is determined primarily by length $d_2$ and length $d_1$ as shown in the graph of FIG. 3. The ring transmission lines may be chosen to be of a type having convenient availability or mechanical characteristics and an appropriate diameter cylinder may be then selected to provide the desired degree of ripple.

Figure 4A:
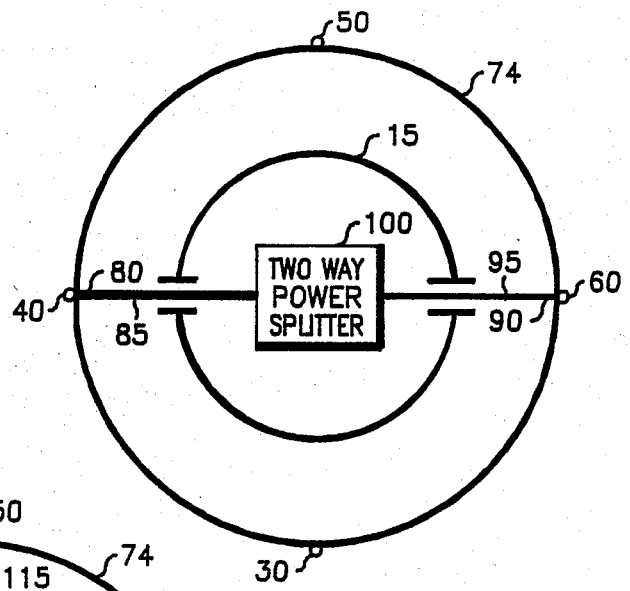
FIG. 4*a* is a section of the antenna section of FIG. 1 taken along lines 4—4 showing one embodiment of a feed arrangement for the antenna of the present invention.
Figure 4B:
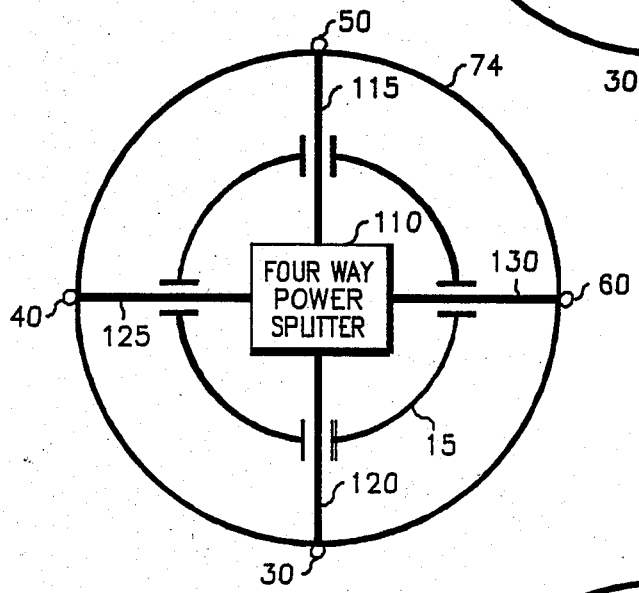
FIG. 4*b* is a section of the antenna section of FIG. 1 taken along lines 4—4 showing an alternate embodiment of a feed arrangement for the antenna of the present invention.
Figure 4C:
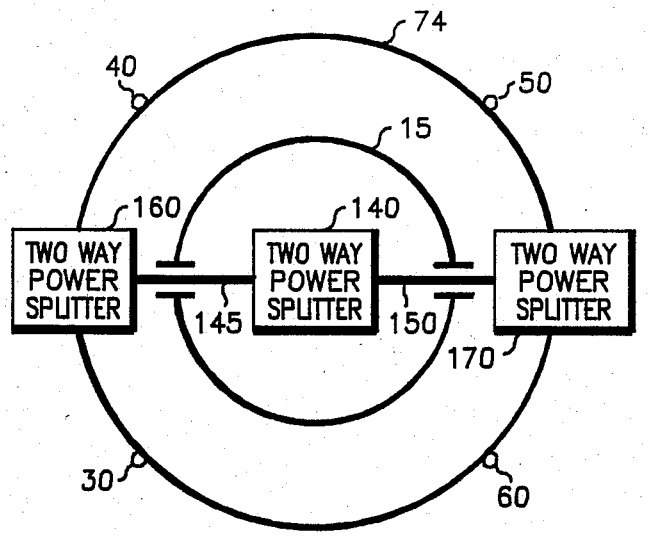
FIG. 4*c* is a section of the antenna section of FIG. 1 taken along lines 4—4 showing an alternate embodiment of a feed arrangement for the antenna of the present invention.

One great advantage of the present structure is that hollow conductive cylinder 15 may be utilized to house cables, matching networks, power splitters, etc. which may be necessary to drive one or more of the antenna sections 10. Turning now to FIGS. 4*a*, 4*b* and 4*c* three examples of input networks which may be utilized to couple electrical energy to the distribution network of ring transmission lines are shown. FIGS. 4*a*, 4*b*, and 4*c* are sectional views taken along section lines 4—4 of FIG. 1. FIG. 4*a* shows one of the simplest symmetrical feed arrangement for the present invention.

In FIG. 4*a* drive points 80 and 90 are fed by transmission lines 85 and 95 which are preferrably of equal lengths. Transmission line 85 and 95 are coupled to a two-way power splitter 100 which is driven by an input transmission line which is not shown. This arrangement provides some symmetrical power distribution to antenna section 10.

In an alternate embodiment shown in FIG. 4*b* a four-way power splitter 110 may be utilized to divide an incoming signal into four components. Four transmission lines 115, 120, 125 and 130 are utilized to couple each of these components of the incoming signal to columns 50, 30, 40 and 60 respectively. In utilizing this configuration, the signal components on transmission lines 125 and 130 should be 180° out-of-phase with the signal components on transmission lines 115 and 120. This input network provides somewhat more balance drive to the distribution network and the vertical columns at only slightly greater complexity.

In a third alternative embodiment shown in FIG. 4*c* a two-way power splitter 140 is utilized to divide the incoming signal into two in-phase components delivered by transmission lines 145 and 150 to two-way power splitters 160 and 170, respectively. If the outputs of power splitters 160 and 170 are inphase, then the connections of radiators 43 and 44 to transmission line 74 must be exchanged and the connections of radiators 63 and 64 to transmission line 74 must be exchanged. Alternatively, the outputs of power splitters 160 and 170 must each be 180 degrees out of phase with the like phases connected to the transmission lines nearest columns 40 and 60 and well as 30 and 50. Power splitters 160 and 170 are centrally located between columns 30 and 40 and columns 50 and 60 respectively on the central ring. transmission line 74. This power splitter arrangement has also been found highly effective in delivering balanced power to the antenna section. It will be clear to those skilled in the art that the outputs of two-way power splitter 140 should be of similar phase. It will also be clear to those skilled in the art that many other variations of balanced input networks may be utilized in conjunction with the present antenna structure. It is also clear that an an odd number of radiating elements may be utilized in each column with the drive signal being applied in the center of the center-most radiating elements.

By way of an example of the present invention the following parameters and results may be implemented. It should be understood that the present invention is in no way limited to the dimensions and materials described below and that this set of dimensions is intended only as an example.

The ring transmission lines in this example are constructed of 300 ohm twin-lead having a velocity factor of 0.8. For a designed center frequency of 850 Mhz, one wavelength is approximately equal 35.3 centimeters. This fixes dimension $d_3$ of two wavelengths (in the twin-lead medium) at 56.6 centimeters. Since $d_2$ is preferrably $\frac{1}{4}$ of $d_3$, $d_2$ is fixed at 17.9 centimeters in order to utilize four vertical columns of radiating elements. Each of the vertical radiating elements is made of No. 15 copper wire and is 17.9 centimeters in length.

Cylinder 15 is constructed of commercially available 4.5 inch (11.4 centimeter) outer diameter alumminum tubing. Therefore the ratio of $d_1$ to $d_2$ is equal to approximately 0.64 and the radius $d_2/2$ is approximately equal to $\frac{1}{4}$ of a wavelength. From this information, the graph of FIG. 3 indicates that horizontal ripple will be approximately 0.3 db.

Construction of the antenna resulted in a structure having horizontal pattern characteristics shown in FIG. 5 at 850 Mhz. Ripple of approximately 1.2 db is shown in this pattern. The vertical radiation pattern of this antenna structure is shown in FIG. 6 indicating an approximately 3 db beamwidth of 22° and 1 db beamwidth of approximately 4°. The discrepency in horizontal pattern ripple is attributed to measurement error in that a 4° error in vertical angle can account a 1 db error in the horizontal pattern.

The present antenna section also resulted in a wide pattern bandwidth of approximately 70 MHz making the antenna highly useful between the frequencies of approximately 810 MHz and 880 Mhz. The antenna exhibited approximately 7 dbi of gain which is approximately equal to 5 dbd.

By parallel feeding a plurality of the present antenna sections and vertically stacking the sections as shown in FIG. 7 the wide bandwidth of each individual section may be preserved while enhancing the gain by approximately 3 db for every doubling in overall length. The distance at which the cylinders 15 extend beyond the end most ring transmission line is shown in FIG. 7 as $d_6$. It has been found convenient to make this distance approximately one half wavelength but this is not to be limiting as other distances may work equally well.

While two wavelengths have been shown to be appropriate for the circumference of the ring transmission lines it will be clear that any multiple of a wavelength may be utilized. It will also be noted that the gain of each individual section as described increases with the number of radiating elements in each column with a practical maximum length for the present application of approximately 8 radiating elements. This practical maximum results from the narrowing of useable bandwidth as the length is increased as is characteristic of series fed radiators. However, this practical maximum may not hold for other applications and is not to be limiting. One of the primary advantages of the present configuration is that it may be parallel fed thereby limiting the bandwidth only by the length of a section and not by the length of the vertically stacked array. It will also be clear that separately feeding several sections will allow some degree of vertical pattern shaping which may be important in some applications. In any event, by placing the feed lines within the cylinder 15, antenna pattern degredation by radiation and scattering from the feed line may be minimized.

Figure 8:
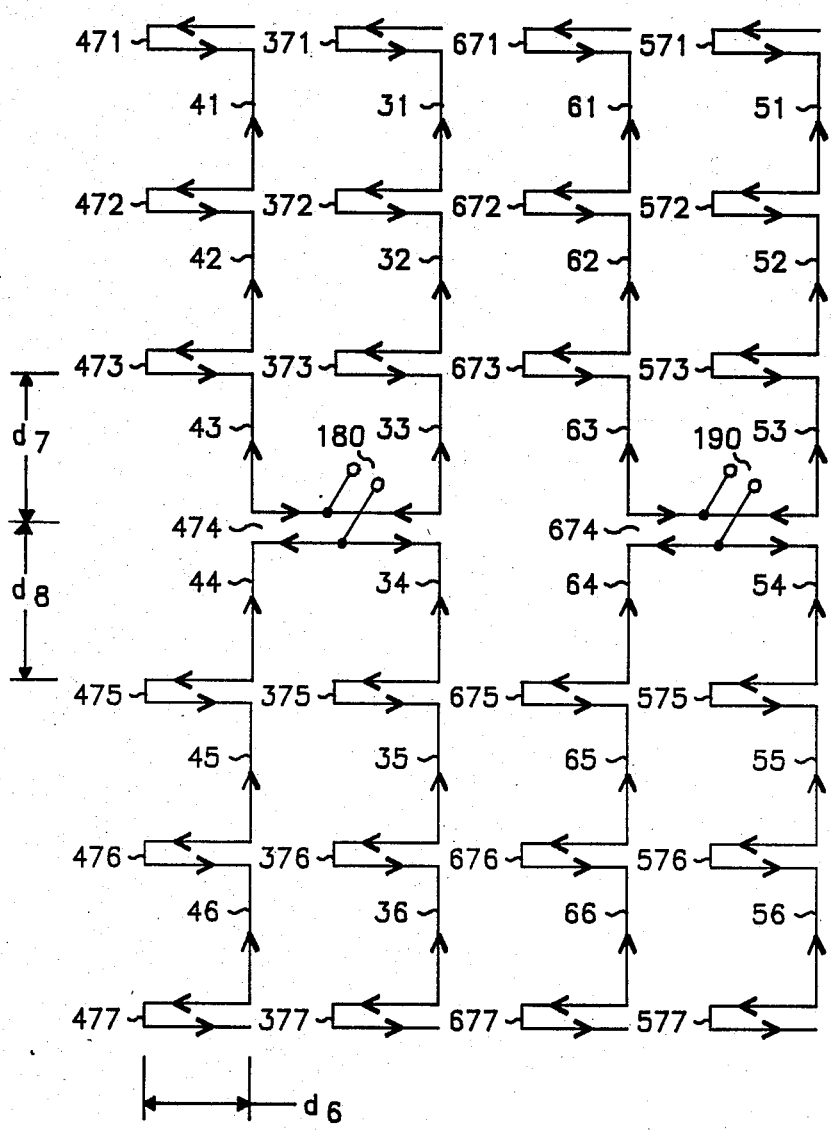
FIG. 8 is an unwrapped view of an alternate embodiment of the present invention.

Turning now to FIG. 8, an alternate embodiment of the present invention is shown. This view which is similar to the view of FIG. 2 shows a planar view of the radiating elements and distribution network of this alternative embodiment which is unwrapped from the central conductive cylinder.

In this embodiment a plurality of vertical radiating elements are arranged in four columns in a similar manner as the previous embodiment. One column includes vertical radiating elements 41–46; a second column includes vertical radiating elements 31–36; a third column includes vertical radiating elements 61–66; and a fourth column includes vertical radiating elements 51–56. In this embodiment however, the ring transmission line distribution network of the previous embodiment has been replaced by a plurality of quarter wavelength shorted transmission lines stubs or their electrical equivalent. Each of these stubs presently has a length $d_6$ of approximately one quarter wavelength in the transmission line medium.

The upper end of radiating elements 41, 31, 61 and 51 are connected to one conductor of stubs 471, 371, 671 and 571 respectively. The lower end of elements 41, 31, 61 and 51 are coupled to the upper conductor of stubs 472, 372, 672 and 572 respectively.

The lower conductor of stubs 472, 372, 672 and 572 are coupled to the upper end of radiating elements 42, 32, 62 and 52 respectively. The lower end of elements 42, 32, 62 and 52 are coupled to stubs 473, 373, 673 and 573 respectively. The upper end of radiating elements 43, 33, 63 and 53 are coupled to the lower conductor of stubs 473, 373, 673 and 573 respectively.

In one embodiment, the lower end of radiating elements 43, and 33 are coupled to the upper conductor of a half wavelength transmission line 474 and the lower conductor of transmission line 474 is coupled to the upper ends of radiating elements 44 and 34 respectively. At the centermost portion of transmission line 474 a feedpoint 180 is situated for coupling electrical energy to columns 30 and 40. In a similar manner the lower ends of radiating elements 63 and 53 are coupled together by the upper conductor of half-wave transmission line 674 while the lower conductor of transmission line 674 is coupled to the upper end of radiating elements 64 and 54. At the centermost portion of transmission line 674 a feedpoint 190 is located for providing electrical energy to columns 60 and 50. The lower end of radiating elements 44, 34, 64 and 54 are coupled to the upper conductor of stubs 475, 375, 675 and 575. The lower conductor of stubs 475, 375, 675 and 575 are coupled to the upper ends of radiating elements 45, 35, 65 and 55.

The lower end of radiating elements 45, 35, 65 and 55 are coupled to the upper conductor of stubs 476, 376, 676 and 576 respectively. The lower conductors of stubs 476, 376, 676 and 576 are coupled to the upper ends of radiating elements 46, 36, 66 and 56. The lower end of radiating elements 46, 36, 66 and 56 are coupled to the upper conductors of stub 477, 377, 677 and 577 respectively.

In one embodiment according to FIG. 8 the lengths of the vertical radiating element is approximately one half wavelength but this is not to be limiting. It has been found that the length of radiators 43, 33, 63 and 53 shown as $d_7$ in FIG. 8 and the lengths of elements 44, 34, 64 and 54 shown in as length d8 in FIG. 8 may be adjusted in order to improve impedance matching at feedpoints 180 and 190. Also included in FIG. 8 are arrowheads indicating the instantaneous direction of current flow similar to those shown in FIG. 2. It will be clear to one skilled in the art, that the network of FIG. 8 also provides the result described in FIG. 2 in that the current flow in each of the vertical radiating elements is in the same direction while virtually all horizontal radiating energy is cancelled by substantially equal and opposite current flow in the stubs.

The arrangement of FIG. 8 has been shown to provide performance similar to that of the arrangement of FIG. 2. However, it will be clear to those skilled in the art that the arrangement of FIG. 8 may be more readily adaptable to varying needs since length $d_2$ may be readily chosen without the restrictions of a required length for a ring transmission line as in the structure of FIG. 2 providing that an alternate mechanism for driving the structure (without using transmission lines 474, 674) is devised. Other configuration with advantages specific to the individual structures will occur to those skilled in the art.

Thus, it is apparent that in accordance with the present invention, an apparatus that fully satisfies the objectives, aims and advantages is set forth above. While the invention has been described in conjunction with a specific embodiment, it is evident that many alternatives, modifications and veriations will become apparent to those skilled in the art in light of the foregoing description. Accordingly, it is intended that the present invention embrace all such alternatives, modifications and variations as fall within the spirit and broad scope of the appended claims.

What is claimed is:

1. A high gain antenna structure for operation over a predetermined range of frequencies about a predetermined center frequency, comprising:

a hollow vertical conductive cylinder having a first radius about a vertical central axis;

an array of vertical radiating elements disposed around said conductive cylinder at a second radius about said central axis, said second radius being larger in magnitude than said first radius;

said vertical radiating elements being arranged in a plurality of vertical columns and having a number N of vertical radiating elements in each column, said vertical columns being arranged symetrically about said axis;

distributing means for supplying electrical energy to each of said vertical radiating elements so that the instantaneous current flows in the same direction in all of said vertical radiating elements, and wherein any horizontal currents flowing in said distribution means are substantially cancelled by out-of-phase horizontal currents; and input means, coupled to said distributing means and positioned within said hollow vertical conductive cylinder, for receiving an electrical signal and supplying said signal to said distributing means;

wherein N is an even number and wherein said distributing means includes at least $N-1$ ring parallel transmission lines having radius approximately equal to said second radius, and wherein each of said vertical radiating elements includes an upper and a lower end and wherein each adjacent upper and lower end of vertically adjacent vertical radiating elements is coupled to one of said ring parallel transmission lines.

2. The antenna structure of claim 1, wherein said vertical radiating elements are approximately one half wavelength long at said predetermined center frequency.

3. The antenna structure of claim 1, wherein said vertical radiating elements are arranged in four symmetrical vertical columns having an even number of vertical radiating elements in each column.

4. The antenna structure of claim 1, wherein said input means and one of said ring parallel transmission lines are coupled together near said central portion.

5. The antenna structure of claim 1, wherein the circumferential distance between adjacent couplings of said vertical radiating elements on each of said ring parallel transmission lines is approximately one half wavelength at said predetermined center frequency.

6. The antenna structure of claim 1, wherein said input means includes a power splitter having an input for receiving said electrical signal and a plurality of outputs coupled to one of said ring parallel transmission lines for symmetrically providing appropriately phased electrical energy to said one ring parallel transmission line.

7. The antenna structure of claim 6, wherein said distributing means includes a plurality of power splitting means corresponding to and coupled to said plurality of outputs, for providing symmetrical distribution of said electrical energy to said one ring parallel transmission line.

8. The antenna structure of claim 1 wherein said distributing means includes N+1 ring parallel transmission lines and wherein each end of said vertical radiating elements is coupled to one of said ring parallel transmission lines.

* * * * *